United States Patent [19]

Knight

[11] 3,946,443

[45] Mar. 30, 1976

[54] DISPOSABLE RAIN GARMENT

[75] Inventor: Hoye Knight, New York, N.Y.

[73] Assignee: Raymond Lee Organization, Inc., New York, N.Y.

[22] Filed: Jan. 17, 1973

[21] Appl. No.: 324,293

[52] U.S. Cl. ..... 2/82; 2/84
[51] Int. Cl.[2] ..... A41D 3/08
[58] Field of Search ..... 2/82, 84, 49 R, 87, 80

[56] References Cited

UNITED STATES PATENTS

| | | | |
|---|---|---|---|
| 1,292,307 | 1/1919 | Globerman | 2/84 |
| 2,305,605 | 12/1942 | Craig et al. | 2/82 X |
| 2,711,538 | 6/1955 | De Cordero | 2/84 |
| 3,299,440 | 1/1967 | Grable | 2/49 R |
| 3,665,518 | 5/1972 | Leadford | 2/87 |

FOREIGN PATENTS OR APPLICATIONS

| | | | |
|---|---|---|---|
| 904,803 | 8/1962 | United Kingdom | 2/84 |

*Primary Examiner*—H. Hampton Hunter
*Attorney, Agent, or Firm*—Howard I. Podell

[57] ABSTRACT

A disposable rain garment, adaptable to be dispensed from a continuous sheet which is storable on a roller, prior to use.

The garment is formed of a double layer of waterproof material such as plastic sheeting, and pre-cut to form leg sections and arm sections, with a hood section which encloses the wearer's shoulders and head. Each leg section is fitted with straps at the bottom ends so as to tie about the undersoles of the shoes of the wearer.

The garment may be dispensed from rollers hung in stores immediately prior to and during a rainstorm, and the garment is readily disposed of after the need has passed.

5 Claims, 5 Drawing Figures

DISPOSABLE RAIN GARMENT

SUMMARY OF THE INVENTION

This invention relates to a disposable rain garment which may be dispensed in continuous sheet form from rollers, when required, The garment encloses all of the outer clothes of the wearer, including the hair or a hat, and ties about the undersoles of the wearer's shoes.

The advantage of this invention is that the inexpensive nature of the garment and the ready means of storage prior to sale will make the garment available for purchase when required, immediately prior to, or during a rainstorm. The garment encloses all of the outer apparel of the wearer, and is readily disposed of after it has served its purpose.

The garment is in the form of a double sheet of waterproof material that is storable in continuous sections on a roller. Sections are fitted with tear lines for arm sleeves and for forming pants legs which are tied about the undersoles of the wearer's shoes.

The top section of the garment is formed of two panels which form a hood for fastening over the back and sides of the wearer's head, and over the shoulders and front of the wearer's neck.

BRIEF DESCRIPTION OF THE DRAWINGS:

The objects and features of the invention may be understood with reference to the following detailed description of an illustrative embodiment of the invention, taken together with the accompanying drawings in which.

DESCRIPTION OF THE PREFERRED EMBODIMENT

Figure 1:
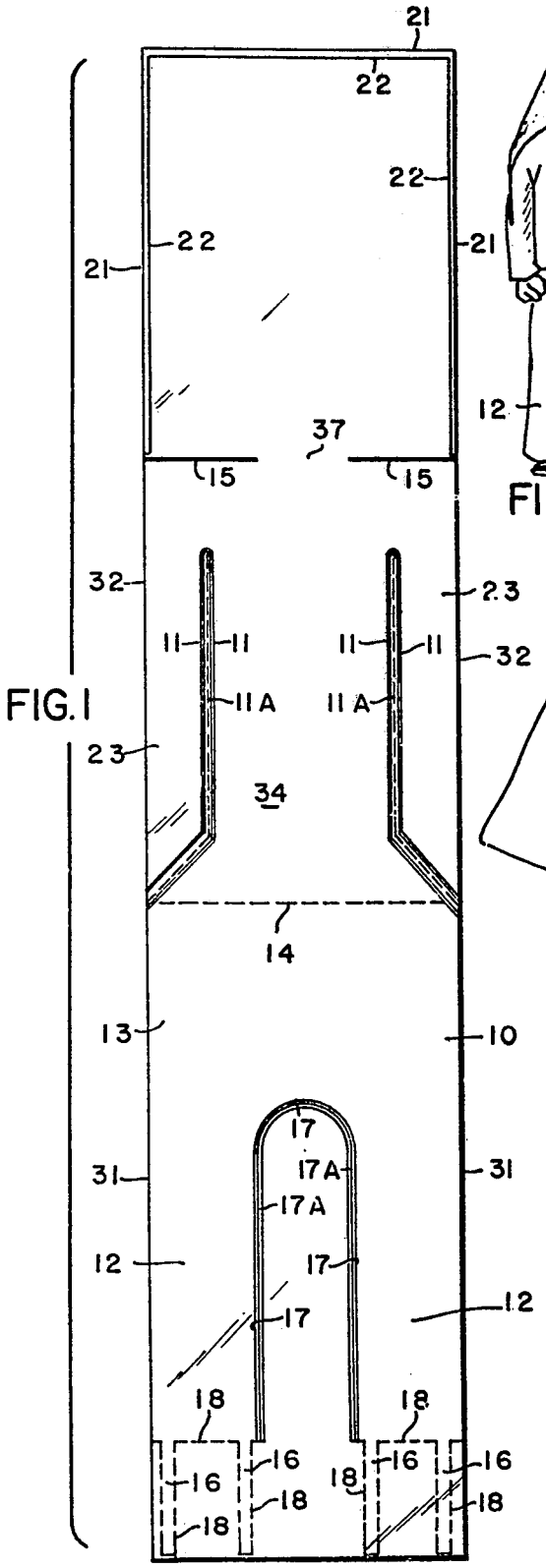
FIG. 1 is an elevation view of the garment, as dispensed from a continuous sheet.
Figure 2:
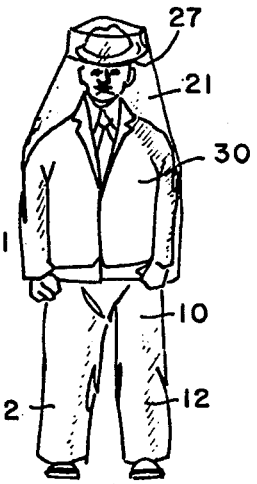
FIG. 2 is an elevation view of the front of the garment and wearer.
Figure 3:
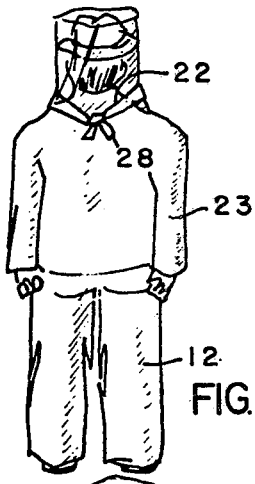
FIG. 3 is an elevation view of the back of the garment and wearer.
Figure 4:
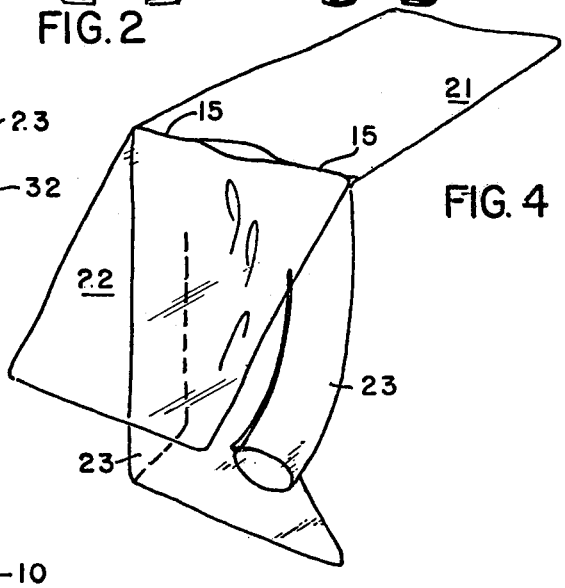
FIG. 4 is a perspective view of the garment being prepared for wearing.
Figure 5:
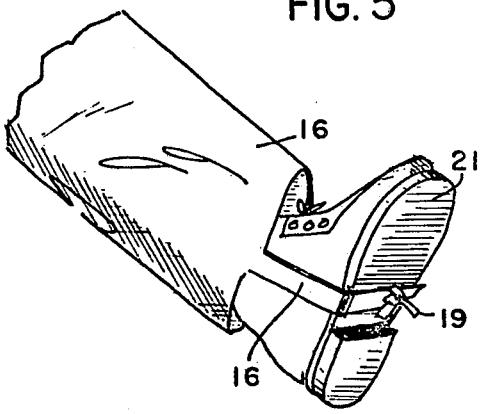
FIG. 5 is a fragmentary perspective view of a leg of the garment fastening about the undersole of the wearer's shoe.

Turning now descriptively to the drawings, in which similar reference characters denote similar elements throughout the several views, FIG. 1 illustrates the garment 10 as it is removed from a roll, being formed of a double layer of waterproof sheeting, preferably of plastic material, with the two layers of sheeting joined together along the outer sides 31 of the pants section 13, the outer sides 32 of the sleeve sections 23, the inner seam line 17 of the pants section, the inner seam line 11 separating the sleeve sections 23 from the waist section 34, and the seamed shoulder lines 15 which partially separate the waist section 34 from the hood sections 21 and 22.

The shoulder seams 15 are each perpendicular to the sides 32 which they join, but each shoulder seam 15 is terminated short of the neck section 37.

Tear lines are formed consisting of perforated holes or other easily torn means with pants tear line 14 lying perpendicular to the sides of the sheeting separating the pants section 13 completely from the waist section 34, and sleeve tear line 11A separating sleeve seam line 11 so as to retain seam line 11 on both sides of the torn tear line 11A. Strap tear lines 18 delineate the straps 16 at the bottom of each pants leg 12, and tear line 17A separates the pants legs sections 12.

When initially formed, there is no seam nor joint between the front hood sheet 22 and the rear hood sheet 21 save for the two shoulder seams 15.

As shown in FIG. 1–5 the garment is worn by initially separating the pants section 13 from the waist sections 34 along tear line 14, and separating the pants legs 12 and leg straps 16 along their adjoining tear lines 17A and 18 respectively.

The pants section 13 may then be put on by the wearer over his clothing pants and straps 16 tied together in a knot 19 under the shoes. The arm sections 23 are separated from the waist section 34 along tear lines 11A, and the waist section put on by the wearer, with the attached front hood 22 and the rear hood 21, which are separate from each other. The rear hood section 21 is tied about the back and over the head or hat 27 of the wearer, with corners tucked under the hat 27. The front hood section 22 is tied about the neck and fastened together with a knot 28 about the back of the neck, leaving the face free.

The entire garment is inexpensively produced and may be discarded by the wearer after one-time use.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A disposable outergarment to be worn over the customary clothing as a protection from rain and splatter, which is adaptable for storage prior to use and prior to dispensing on a roll, comprising two layers of plastic sheeting of generally uniform width which is formed with a lateral tear line so as to separate a pants section from a waist section, with shaped tear lines and shaped seams joining both layers in the pants section to form two separate leg sections of the pants section, and with shaped tear lines and shaped seams joining both layers in the waist section to form two separate arm sections in the waist section.

2. The combination as recited in claim 1 in which tear lines at the bottom of each of the leg sections of the pants section form straps which may be tied together under the soles of the wearer's shoes.

3. The combination as recited in claim 1 in which a hood section is delineated from the attached waist section by two seams joining the two layers which form two shoulder borders, and with a neck section, between the two shoulder borders connecting the waist section to each attached hood section, remaining unseamed.

4. The combination as recited in claim 3 in which each of the layers of the two layers of plastic sheeting forming a hood section is independent of the other layer of sheeting which forms the other hood section, save for the shoulder seams.

5. A plurality of outer garments described in claim 1, joined together, end to end, and formed in a roll.

* * * * *